US011345512B1

(12) United States Patent
Zheng

(10) Patent No.: US 11,345,512 B1
(45) Date of Patent: May 31, 2022

(54) PARTS STORAGE BOX

(71) Applicant: Chenlei Zheng, Yueqing (CN)

(72) Inventor: Chenlei Zheng, Yueqing (CN)

( * ) Notice: Subject to any disclaimer, the term of this patent is extended or adjusted under 35 U.S.C. 154(b) by 0 days.

(21) Appl. No.: 17/507,818

(22) Filed: Oct. 22, 2021

(30) Foreign Application Priority Data

Sep. 30, 2021 (CN) ..... 202122406239.7

(51) Int. Cl.

| | |
|---|---|
| ***B25H 3/02*** | (2006.01) |
| ***B65D 25/06*** | (2006.01) |
| ***B65D 25/04*** | (2006.01) |
| ***B65D 51/24*** | (2006.01) |
| ***B65D 43/16*** | (2006.01) |
| ***B65D 25/28*** | (2006.01) |

(52) U.S. Cl.
CPC ..... *B65D 25/04* (2013.01); *B25H 3/021* (2013.01); *B65D 25/06* (2013.01); *B65D 25/2808* (2013.01); *B65D 43/164* (2013.01); *B65D 51/242* (2013.01)

(58) Field of Classification Search
CPC ..... B65D 25/06; B65D 77/046; B65D 43/164
See application file for complete search history.

(56) References Cited

U.S. PATENT DOCUMENTS

| | | | | |
|---|---|---|---|---|
| 7,794,002 | B2 | 9/2010 | Yano et al. | |
| 8,459,488 | B2 * | 6/2013 | Pannier, II | B65D 25/04 220/528 |
| 9,090,217 | B2 | 7/2015 | Atsuchi et al. | |
| 9,902,456 | B2 | 2/2018 | Mizuta et al. | |
| 2005/0045522 | A1 * | 3/2005 | Corcoran | B65D 21/0223 206/561 |
| 2006/0070900 | A1 * | 4/2006 | Brunson | B25H 3/003 206/373 |
| 2012/0152944 | A1 * | 6/2012 | Vilkomirski | B25H 3/022 220/4.28 |
| 2017/0165829 | A1 * | 6/2017 | Damberg | B65D 43/16 |
| 2019/0009403 | A1 * | 1/2019 | Huang | B65D 21/023 |

* cited by examiner

*Primary Examiner* — Mollie Impink
(74) *Attorney, Agent, or Firm* — Benjamin H. B. Sley

(57) ABSTRACT

A parts storage box includes a box cover, a box body and a plurality of storage compartments. Each of the storage compartments includes a bottom portion and side wall portions which are connected to one another. The box cover is arranged on the box body, and an accommodation space formed between the box cover and the box body is used for placing the plurality of storage compartments. Limiting members used for fixing the storage compartments are arranged on the box cover or the box body. Through the arrangement of the limiting members for limiting the storage compartments on the box body or the box cover, the present disclosure can reduce the incidence of shaking in the storage compartments, thereby reducing the circumstances where parts inside a box are all tangled up due to the misoperation of a user.

10 Claims, 3 Drawing Sheets

PARTS STORAGE BOX

CROSS-REFERENCE TO RELATED APPLICATIONS

This application claims priority to Chinese Patent Application No. 202122406239.7 with a filing date of Sep. 30, 2021. The content of the aforementioned application, including any intervening amendments thereto, is incorporated herein by reference.

TECHNICAL FIELD

The present disclosure relates to the field of storage, and in particular to a parts storage box.

BACKGROUND

Hardware parts are auxiliary and accessory products used in everyday life and industrial production. In the early stage, gold, silver, copper, iron, tin and other metallic materials are usually used for manufacturing hardware parts, from which the name of the hardware parts is derived. Nowadays, in addition to various metallic materials, plastics, glass fiber and other non-metallic materials are also widely used for manufacturing the hardware parts. In the field of hardware parts storage, for the purpose of meeting various demands in practical work, a user usually needs to use various storage boxes with compartments to place hardware parts of different types in work. However, given that an existing hardware parts storage box is usually fixed and partitioned by using partition sheets, the partition sheets are very likely to be scattered when hardware parts are taken out and placed, making parts all tangled up in the box.

SUMMARY

The technical problem to be solved by the present disclosure is to provide a parts storage box aiming at the foregoing defects in the prior art, so as to overcome the defect that parts may be easily tangled up in a storage box in the prior art.

The embodiments of the present disclosure provide a parts storage box, including a box cover, a box body, and a plurality of storage compartments, where each of the storage compartments includes a bottom portion and side wall portions which are connected to one another; the box cover is arranged on the box body, and an accommodation space formed between the box cover and the box body is used for placing the plurality of storage compartments; and limiting members used for fixing the storage compartments are arranged on the box cover or the box body.

There are a plurality of the limiting members which are arranged in an array; the plurality of storage compartments include at least one first storage compartment and at least one second storage compartment; and a ratio of a volume of the second storage compartment to that of the first storage compartment is a first preset value which is an integer greater than 1;

each of the limiting members is capable of limiting the first storage compartments; and a first component is capable of limiting the second storage compartments, where the first component is composed of a first preset number of the limiting members which are sequentially adjacent to one another.

The shape of the limiting members matches that of top or bottom portions of the first storage compartments; and the shape of the first components matches that of top or bottom portions of the second storage compartments.

The plurality of storage compartments further include at least one third storage compartment, and a ratio of a volume of the third storage compartment to that of the first storage compartment is a second preset value which is an integer greater than the first present value; and a second component is capable of limiting the third storage compartments, where the second component is composed of a second preset number of the limiting members which are sequentially adjacent to one another.

The shape of the limiting members matches that of top or bottom portions of the first storage compartments; the shape of the first components matches that of top or bottom portions of the second storage compartments; and the shape of the second components matches that of top or bottom portions of the third storage compartments.

Herein, a supporting member is arranged on one side, facing the box body, of the bottom portion of each storage compartment; and the limiting members are arranged on a bottom surface, facing a cover body, of the box body, which are specifically limiting grooves to be used for accommodating and limiting the supporting members.

The limiting members are arranged on one side, facing the box body, of the box cover, and protrude from a surface of the box cover, and the limiting members are used to limit top openings of the storage compartments, and can enter a storage space defined by the storage compartments once the box cover covers the box body.

The first storage compartments are in a shape of a cuboid or a cube; each limiting member includes oppositely-arranged first limiting parts and oppositely-arranged second limiting parts;

a shape defined by the first limiting parts and the second limiting parts matches that of an opening of each of the first storage compartments;

each first limiting part includes two oppositely-arranged right-angled parts; and in a direction away from the first limiting parts, a protruding height of the second limiting parts is gradually increased.

Herein, every two adjacent limiting members are mirror-symmetrical.

The box cover is transparent; handle structures are correspondingly arranged on the box cover and the box body; and the box cover covers the box body via a padlock.

The embodiments of the present disclosure have the beneficial effects as follows: the arrangement of a plurality of storage compartments with side walls and bottom walls in the box body makes it possible to take out each of the storage compartments from the box body and separately store parts, thereby avoiding the occurrence of the situation that the partition sheets are very likely to be scattered when hardware parts are taken out and placed; and meanwhile, the arrangement of the limiting members for limiting the storage compartments on the box body or the box cover can reduce the incidence of shaking in the storage compartments, such that circumstances where parts inside a box are all tangled up due to the misoperation of a user are reduced.

BRIEF DESCRIPTION OF THE DRAWINGS

The present disclosure will be described below in further detail with reference to the accompanying drawings and embodiments.

DETAILED DESCRIPTION OF THE EMBODIMENTS

A clear and complete description of the technical solutions in the embodiments of the present disclosure will be given below, in combination with the accompanying drawings in the embodiments of the present disclosure. Apparently, the embodiments described below are a part, but not all, of the embodiments of the present disclosure. All other embodiments obtained by a person of ordinary skill in the art based on the embodiments of the present disclosure without inventive efforts fall within the protection scope of the present disclosure.

It should be noted that the directional indications (such as upper, lower, left, right, front, back, etc.) in the embodiments of the present disclosure, if any, are merely used to explain a relative position relationship, motion situations, and the like of the components in a specific gesture (as shown in the figures). If the specific gesture changes according to the results, the directional indication also changes accordingly.

Moreover, the terms such as "first", "second", and the like described in the embodiments of the present disclosure, if any, are used herein only for the purpose of description, and should not be construed as indicating or implying relative importance, or implicitly indicating the quantity of the indicated technical features. Therefore, features defined by "first" and "second" may explicitly or implicitly include at least one of the features. Furthermore, the technical solutions between the various embodiments may be combined with each other, but must be on the basis that the combination thereof can be implemented by a person of ordinary skill in the art. In case of a contradiction with the combination of the technical solutions or a failure to implement the combination, it should be considered that the combination of the technical solutions does not exist, and is not within the protection scope of the present disclosure.

Figure 1:
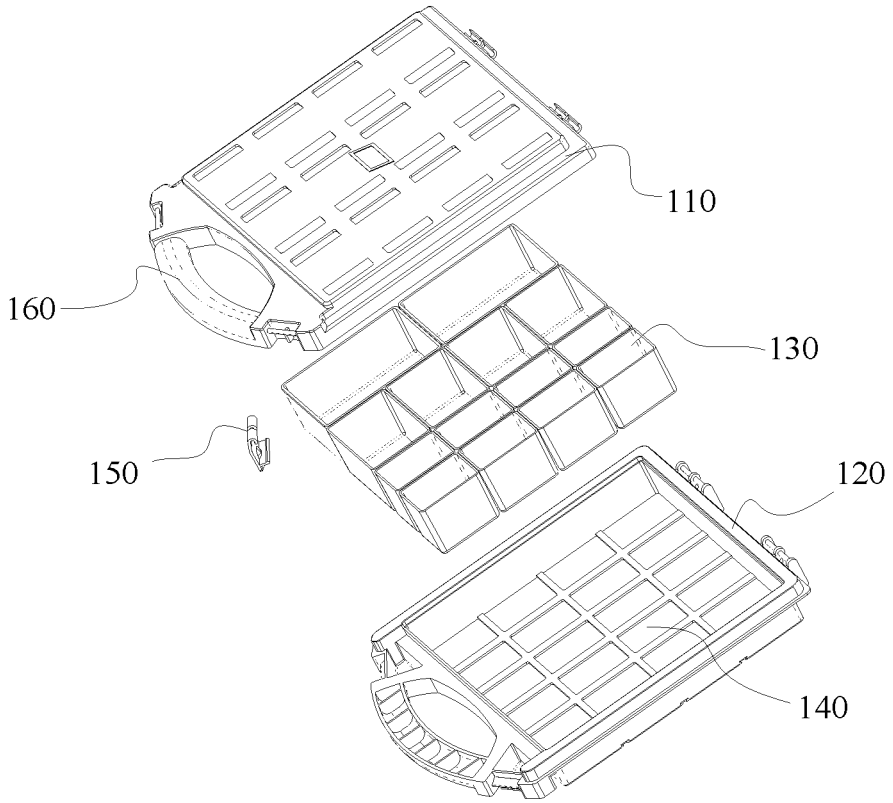
FIG. 1 is an exploded view of a parts storage box according to embodiments of the present disclosure.

As shown in FIG. 1, a parts storage box includes a box cover 110, a box body 120 and a plurality of storage compartments 130. Each of the storage compartments 130 includes a bottom portion 130*b* and side wall portions 130*c* which are connected to one another. The box cover 110 is arranged on the box body 120, and an accommodation space formed between the box cover 110 and the box body 120 is used for placing the plurality of storage compartments 130; limiting members 140 used for fixing the storage compartments 130 are arranged on the box cover 110 or the box body 120.

A top of each of the storage compartments 130 is provided with an opening, which can be in a shape of a polyhedron such as a cuboid, a cube, a cylinder or in other shape, and in the embodiments, a cuboid or a cube is preferred. Each of the storage compartments 130 can be set to the same height. The height of each of the storage compartments 130 can be slightly less than or equal to that of an accommodation space formed between the box cover 110 and the box body 120. The plurality of storage compartments 130 may have identical or different shapes and sizes. To make it convenient for a user to view parts in the storage compartments 130, the box cover 110 can be set as a transparent cover. The box cover 110 and the box body 120 are hinged together. The box cover 110 can tightly cover the box body 120 through a padlock 150. To facilitate carry, two handle structures 160 are correspondingly arranged on the box cover 110 and the box body 120, which are symmetric to each other and can form an entire handle once the box cover 110 covers the box body 120.

Figure 3:
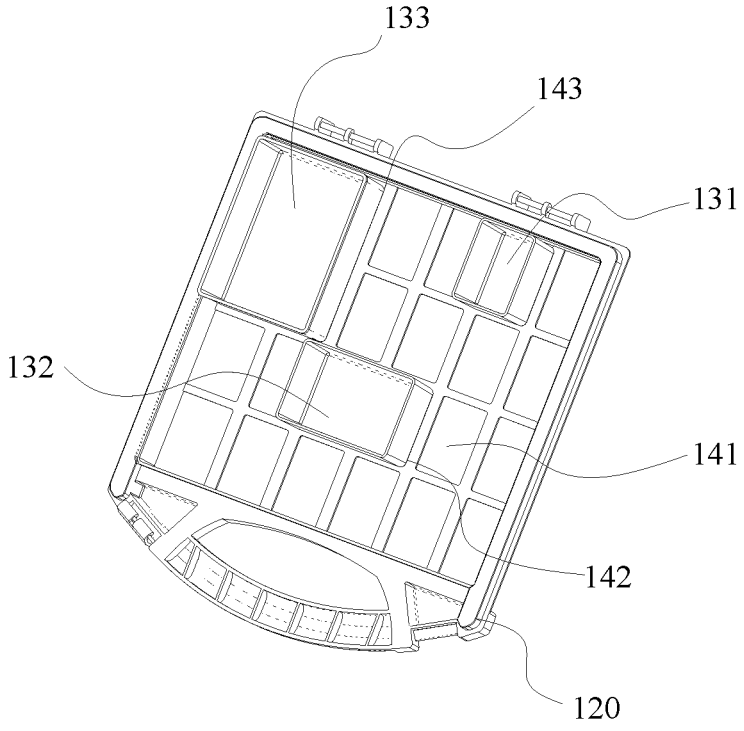
FIG. 3 is a structural diagram of assembly of a box body and storage compartments of the present disclosure.

Preferably, there are a plurality of limiting members 140 which are arranged in an array. As shown in FIG. 3, the plurality of storage compartments 130 include at least one first storage compartment 131 and at least one second storage compartment 132. A ratio of a volume of the second storage compartment 132 to that of the first storage compartment 131 is a first preset value, which is an integer greater than 1, such as 2, 3, 4, etc. When each storage compartment 130 is a cuboid, preferably, the value of the length of each first storage compartment 131 may be equal to the value of the width of each second storage compartment 132 for the purpose of better placing the storage compartments 130 and improving the space utilization. Classified storage of parts of different sizes can be realized by setting storage compartments 130 to different volumes.

Each limiting member 140 can limit the first storage compartments 131. A first component 142 can limit the second storage compartments 132, where the first components 142 are composed of a first preset number of the limiting members 140 which are sequentially adjacent to one another. The shape of the limiting members 140 may or may not match that of top or bottom portions of the first storage compartments 131. For example, a plurality of insertion holes may be arranged on a bottom portion of the box body 120, and at least one insertion member is arranged at the bottom portion of each storage compartment 130, where the sectional area of each insertion hole is slightly greater than that of each insertion member. When the insertion members are correspondingly inserted into the insertion holes, limiting on the storage compartments 130 is realized through the limiting effect of the insertion holes on the insertion members.

Preferably, in order to better fix the storage compartments 130, the shape of the limiting members 140 may be set to match that of top parts of bottom portions of the first storage compartments 131; and the shape of the first components 142 may be set to match that of top or bottom portions of the second storage compartments 132. When the limiting members 140 are arranged on the box cover 110, the shape of the limiting members 140 matches that of top openings of the first storage compartment 131, and the shape of the first components 142 matches that of top openings of the second storage compartments 132; and when the limiting members 140 are arranged on the box body 120, the shape of the limiting members 140 matches that of bottom portions of the first storage compartments 131, and the shape of the first components 142 matches that of bottom portions of the second storage compartments 132.

Further, the plurality of storage compartments 130 further include at least one third storage compartment 133, and a ratio of a volume of the third storage compartment 133 to that of the first storage compartment 131 is a second preset value which is an integer greater than the first present value. Specifically, the second preset value may be set as the product of two first preset values, for example, the first preset value is 2 and the second preset value is 4. A second component 143 can limit the third storage compartments 133, where the second component 143 is composed of a second preset number of the limiting members 140 which are sequentially adjacent to one another. The shape of the second components 143 matches that of top or bottom portions of the third storage compartments 133. By setting storage compartments 130, i.e., the first storage compartments 131, the second storage compartments 132 and the third storage compartments 133 to different sizes, the storage box can realize the combination of storage compartments 130 of different sizes, and the space allocation in the storage box can be adjusted according to the actual needs of the user; and compared with existing fixed storage compartments 130, higher flexibility is achieved.

Figure 2:
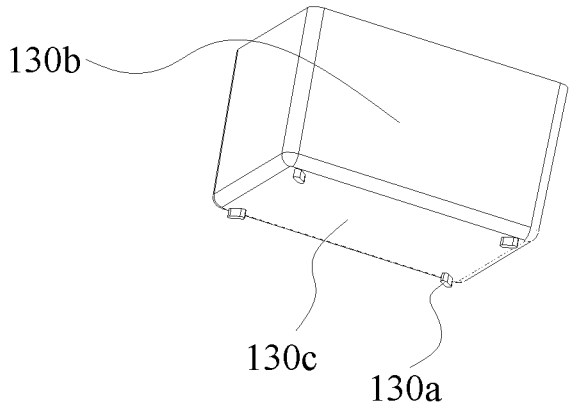
FIG. 2 is a structural diagram of storage compartments according to embodiments of the present disclosure.

As a first implementation, as shown in FIG. 2, a bottom portion of each storage compartment 130 is provided with supporting members 130*a* on one side of the box body 120. The supporting members 130*a* may be arranged at a bottom edge of each storage compartment 130, and the number of the supporting members 130*a* may be one or more. Preferably, each of four corners at a bottom of each storage compartment 130 may be provided with one supporting member 130*a*.

Specifically, a plurality of limiting members 140 arranged in an array may be arranged on a bottom surface, facing the cover body, of the box body 120, as shown in FIG. 3, the limiting members 140 are specifically limiting grooves 141 to be used for accommodating and limiting the supporting members 130*a*. Preferably, the limiting grooves 141 have the same shape and size, and the shape of an opening of each limiting groove 141 matches that of bottom portions of the first storage compartments 131. The area of the opening of each limiting groove 141 is substantially the same as that of the bottom portion of each first storage compartment 131, and preferably, the ratio of the area of the opening of each limiting groove 141 to that of the bottom portion of each first storage compartment 131 is within a range of 90% to 110%. In this way, each of the first storage compartments 131 can be limited via the limiting grooves 141. Since a volume of each second storage compartment 132 is an integral multiple of that of each first storage compartment 131, the first components 142 can also limit the supporting members 130*a* of the second storage compartments 132. The first components 142 are continuously-adjacent limiting grooves 141 with a corresponding number (i.e., a first preset value). The shape of the first components 142 matches that of the second storage compartments 132. Similarly, a volume of each third storage compartment 133 is also an integral multiple of that of each first storage compartment 131, and continuous limiting grooves 141 of a corresponding number can also limit the third storage compartments 133.

Figure 4:
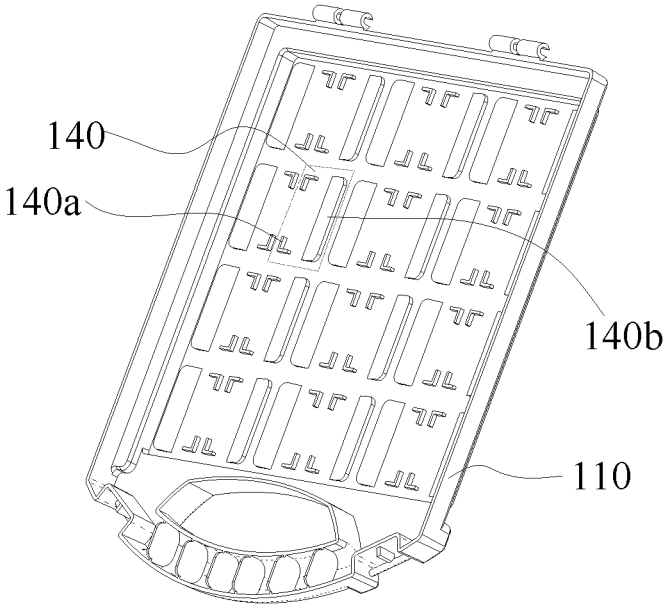
FIG. 4 is a structural diagram of a box cover according to embodiments of the present disclosure.
Figure 5:
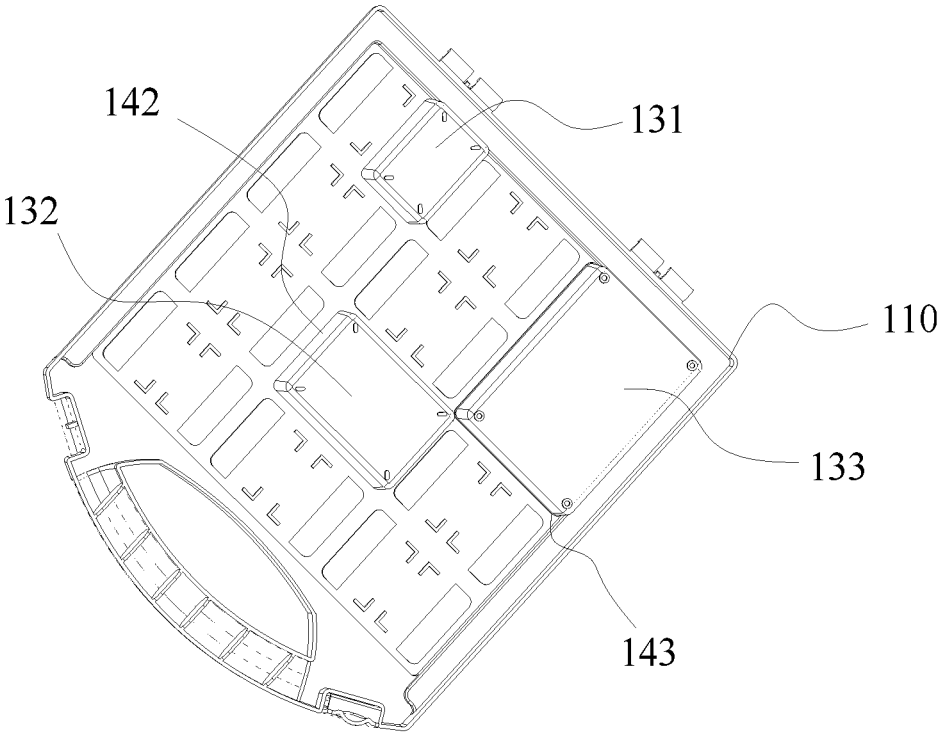
FIG. 5 is a structural diagram of assembly of a box cover and storage compartments of the present disclosure.

As a second implementation, as shown in FIG. 4, a plurality of limiting members 140 arranged in an array may be arranged on one side, facing the box body 120, of the box cover 110, and protrude from a surface of the box cover 110, where the limiting members 140 are used to limit top openings of the storage compartments 130, and can enter a storage space defined by the storage compartments 130 once the box cover 110 covers the box body 120. The storage space is defined by bottom portions and side wall portions of the storage compartments 130. Specifically, each limiting member 140 includes oppositely-arranged first limiting parts 140*a* and oppositely-arranged second limiting parts 140*b*. A shape defined by the first limiting parts 140*a* and the second limiting parts 140*b* matches that of an opening of each of the first storage compartments 131. Preferably, each first storage compartment 131 may be set as a cuboid or a cube, and correspondingly, a cuboid or a cubic shape may be defined by the first limiting parts 140*a* and the second limiting parts 140*b*. Preferably, the area of a shape defined by each first limiting part 140*a* and each second limiting part 140*b* is slightly less than that of an opening of each first storage compartment 131. In order to reduce the interference of the limiting members 140 in a size of the storage space of the storage compartments 130, the first limiting members 140 and the second limiting members 140 are separated and disengaged from each other. Each first limiting part 140*a* includes two oppositely-arranged right-angled parts. Each right-angled part includes a first support arm and a second support arm which are connected to each other at a right angle. The length of each first support arm is supposed to be much smaller than the width of each first storage compartment 131. Further, in order to reduce the interference of the second limiting parts 140*b* in a size of the storage space, a protruding height of the second limiting parts 140*b* is gradually increased in a direction away from the first limiting parts 140*a*. A first side face of each second limiting part 140*b* is attached to the box cover 110, and the first side face is perpendicular to a second side face connected thereto. In order to achieve better limiting, the length of each second limiting part 140*b* may be slightly smaller than that of each first storage compartment 131. In this way, the openings of the first storage compartments 131 can be limited by a limiting member 140, further enabling limiting on the first storage compartments 131. Since a volume of each second storage compartment 132 is an integral multiple of that of each first storage compartment 131, as shown in FIG. 5, the first components 142 can also limit the openings of the second storage compartments 132. The first components 142 are continuously-adjacent limiting members 140 with a corresponding number (i.e., a first preset value). The shape of the first components 142 matches that of openings the second storage compartments 132. Similarly, a volume of each third storage compartment 133 is also an integral multiple of that of each first storage compartment 131, and continuous limiting members 140 of a corresponding number can also limit openings of the third storage compartments 133.

Since the volume of each second storage compartment 132 and the volume of each third storage compartment 133 are both larger than that of the first storage compartment 131, every two adjacent limiting members 140 are mirror-symmetrical in order to better realize the positioning of the second storage compartments 132 and the third storage compartments 133. In this way, it can be guaranteed that the second storage compartments 132 or the third storage compartments 133 can be limited by more second limiting parts 140*b*.

As a third implementation, a plurality of limiting members 140 arranged in an array may be arranged on a bottom surface, facing the cover body, of the box body 120, and meanwhile, a plurality of limiting members 140 arranged in an array are arranged on one side, facing the box body 120, of the box cover 110, such that the storage compartments 130 can be better fixed.

The present disclosure has the advantages as follows: the arrangement of a plurality of storage compartments 130 with side walls and bottom walls in a box body 120 makes it possible to take out each of the storage compartments 130 from the box body 120 and separately store parts, thereby avoiding the occurrence of the situation that the partition sheets are very likely to be scattered when hardware parts are taken out and placed; and meanwhile, the arrangement of the limiting members 140 for limiting the storage compartments 130 on the box body 120 or the box cover 110 can reduce the incidence of shaking in the storage compartments 130, such that circumstances where parts inside a box are all tangled up due to the misoperation of a user are reduced.

The embodiments of the present disclosure have been described above with reference to the accompanying drawings, but the present disclosure is not limited to the foregoing specific embodiments. The foregoing specific embodiments are only illustrative and not restrictive. Under the inspiration of the present disclosure, those of ordinary skill in the art can make many forms without departing from the purpose of the present disclosure and the protection scope defined by the claims, and these forms shall fall within the protection scope of the present disclosure.

What is claimed is:

1. A parts storage box, comprising a box cover, a box body, and a plurality of storage compartments, wherein each of the storage compartments comprises a bottom portion and side wall portions which are connected to one another; the box cover is arranged on the box body, and an accommodation space formed between the box cover and the box body is used for placing the plurality of storage compartments; and limiting members used for fixing the storage compartments are arranged on the box cover or the box body, wherein at least one of the limiting members comprises a top limiting structure that is arranged on the box cover and comprises a first limiting part and a second limiting part, wherein the first limiting part comprises two right-angled members that are oppositely arranged and spaced from each other in a first direction, wherein each right-angled member includes a first support arm and a second support arm connected to each other at a right angle and the second limiting part comprises one single rib extending in the first direction and opposite to and spaced from the two right-angled members of the first limiting part in a second direction that is different from the first direction, the rib protruding from the box cover and comprising a single slope facing the two right-angled members of the first limiting part such that a protruding height of the rib defined by the slope is gradually increased in a direction away from the first limiting part.

2. The parts storage box according to claim 1, wherein there are a plurality of the limiting members which are arranged in an array; the plurality of storage compartments comprise at least one first storage compartment and at least one second storage compartment; and a ratio of a volume of the second storage compartment to that of the first storage compartment is a first preset value which is an integer greater than 1;

each of the limiting members is capable of limiting the first storage compartment; and a first component is capable of limiting the second storage compartment, wherein the first component is composed of a first preset number of the limiting members which are sequentially adjacent to one another.

3. The parts storage box according to claim 2, wherein the limiting members define a shape that matches a shape of top or bottom portion of the first storage compartment; and the first components define a shape that matches a shape of top or bottom portion of the second storage compartment.

4. The parts storage box according to claim 2, wherein the plurality of storage compartments further comprise at least one third storage compartment, and a ratio of a volume of the third storage compartment to that of the first storage compartment is a second preset value which is an integer greater than the first present value; and a second component is capable of limiting the third storage compartment, wherein the second component is composed of a second preset number of the limiting members which are sequentially adjacent to one another.

5. The parts storage box according to claim 4, wherein the limiting members define a shape that matches a shape of top or bottom portion of the first storage compartment; the first component define a shape that matches a shape of top or bottom portion of the second storage compartment; and the second component define a shape that matches a shape of top or bottom portion of the third storage compartment.

6. The parts storage box according to claim 2, wherein supporting members are arranged on one side, facing the box body, of the bottom portion of each storage compartments; and plural ones of the limiting members are arranged on a bottom surface, facing a cover body, of the box body, which are limiting grooves to be used for accommodating and limiting the supporting members.

7. The parts storage box according to claim 2, wherein the limiting members are arranged on one side, facing the box body, of the box cover, and protrude from a surface of the box cover, and the limiting members are used to limit top openings of the storage compartments, and are capable of entering a storage space defined by the storage compartments once the box cover covers the box body.

8. The parts storage box according to claim 7, wherein the first storage compartment is in a shape of a cuboid or a cube; each limiting member comprises the top limiting structure such that the two right-angled members of the first limiting part corresponding to a first one of two opposite sides of the cuboid or cube and the rib of the second limiting part corresponding to a second of the two opposite sides of the cuboid or cube.

9. The parts storage box according to claim 8, wherein every two adjacent limiting members are mirror-symmetrical.

10. The parts storage box according to claim 1, wherein the box cover is transparent; handle structures are correspondingly arranged on the box cover and the box body; and the box cover covers the box body and is selectively locked to the box body.

* * * * *